US010801523B2

(12) United States Patent
Lacher

(10) Patent No.: US 10,801,523 B2
(45) Date of Patent: Oct. 13, 2020

(54) HYDRAULIC CIRCUIT FOR TRAVEL MOTOR

(71) Applicant: Clark Equipment Company, West Fargo, ND (US)

(72) Inventor: Patrick P. Lacher, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 111 days.

(21) Appl. No.: 16/184,502

(22) Filed: Nov. 8, 2018

(65) Prior Publication Data

US 2019/0136875 A1 May 9, 2019

Related U.S. Application Data

(60) Provisional application No. 62/583,253, filed on Nov. 8, 2017.

(51) Int. Cl.
*F15B 11/024* (2006.01)
*F15B 11/08* (2006.01)
(Continued)

(52) U.S. Cl.
CPC ..... *F15B 11/024* (2013.01); *E02F 9/02* (2013.01); *E02F 9/2225* (2013.01); *E02F 9/2253* (2013.01); *E02F 9/2267* (2013.01); *F15B 11/08* (2013.01); *F15B 13/029* (2013.01); *F15B 21/047* (2013.01); *E02F 3/325* (2013.01); *E02F 3/964* (2013.01); *F15B 2211/31529* (2013.01); *F15B 2211/50581* (2013.01); *F15B 2211/77* (2013.01)

(58) Field of Classification Search
CPC ..... E02F 9/226; F15B 21/047; F15B 2211/50581; F15B 2211/31576; F16H 61/4183
See application file for complete search history.

(56) References Cited

U.S. PATENT DOCUMENTS 4,244,276 A * 1/1981 Iwata ..... F15B 11/08 91/447
4,520,625 A * 6/1985 Sato ..... F15B 13/02 60/464

(Continued)

FOREIGN PATENT DOCUMENTS

EP 2042746 A1 4/2009
JP H03229002 A 10/1991
WO 2017188869 A1 11/2017

OTHER PUBLICATIONS

International Search Report and Written opinion dated Jan. 28, 2019 for International Application No. PCT/US2018/059829 filed Nov. 8, 2018, 13 pages.

*Primary Examiner* — Michael Leslie
*Assistant Examiner* — Matthew Wiblin
(74) *Attorney, Agent, or Firm* — John Veldhuis-Kroeze; Westman, Champlin & Koehler, P.A.

(57) ABSTRACT

Disclosed embodiments include travel motor hydraulic circuits for controlling the provision of hydraulic fluid to a travel motor. The travel motor hydraulic circuits include a counterbalance valve configured to block the flow of hydraulic fluid when in a neutral position to prevent unintended movement of a power machine, and an anti-cavitation valve configured to direct flow of hydraulic fluid back to the travel motor to prevent cavitation.

10 Claims, 11 Drawing Sheets

(51) Int. Cl.

| | |
|---|---|
| ***F15B 21/047*** | (2019.01) |
| ***E02F 9/22*** | (2006.01) |
| ***E02F 9/02*** | (2006.01) |
| ***F15B 13/02*** | (2006.01) |
| *E02F 3/96* | (2006.01) |
| *E02F 3/32* | (2006.01) |

(56) References Cited

U.S. PATENT DOCUMENTS

| | | | | | |
|---|---|---|---|---|---|
| 4,628,690 | A * | 12/1986 | Arai | E02F 9/123 | 60/464 |
| 5,992,148 | A * | 11/1999 | Satake | E02F 9/123 | 60/468 |
| 6,068,013 | A * | 5/2000 | Arai | E02F 9/2267 | 137/106 |
| 6,112,521 | A | 9/2000 | Hayashi et al. | | |
| 10,590,908 | B2 * | 3/2020 | Bidell | F04B 1/28 | |
| 2002/0092417 | A1 * | 7/2002 | Suzuki | E02F 9/2267 | 91/436 |
| 2003/0167660 | A1 * | 9/2003 | Kondou | F15B 11/166 | 37/348 |
| 2003/0205426 | A1 | 11/2003 | Lamela et al. | | |
| 2004/0060747 | A1 | 4/2004 | Wetzel et al. | | |
| 2006/0096799 | A1 * | 5/2006 | Tatsuno | F02D 29/02 | 180/305 |
| 2014/0033691 | A1 * | 2/2014 | Peterson | E02F 9/2235 | 60/327 |

* cited by examiner

HYDRAULIC CIRCUIT FOR TRAVEL MOTOR

CROSS-REFERENCE TO RELATED APPLICATION

This application claims the benefit of U.S. Provisional Application No. 62/583,253, which was filed on Nov. 8, 2017.

BACKGROUND

Power machines, for the purposes of this disclosure, include any type of machine that generates power to accomplish a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, and trenchers, to name a few examples.

Many power machines utilize hydraulic systems having one or more travel motors for forward and rearward movement of the machine. The travel motors are bi-directional such that the change between forward and rearward movement provided by the travel motor is achieved by reversing the direction of flow of hydraulic fluid to the travel motor. When controlling flow of hydraulic fluid to the travel motor, for example when switching the direction of flow in order to change the travel motor direction of travel, cavitation can occur in the hydraulic circuit, and can damage components such as the travel motor or the hydraulic pump, which provides hydraulic fluid to the travel motor. Further, in some hydraulic circuits, a commanded change in direction of the travel motor can take an excessive amount of time before a steady state is reached, resulting in the power machine being somewhat unresponsive to the operator. A momentarily unresponsive travel motor can eventually experience a very abrupt direction change or shock by allowing the hydraulic system to eventually achieve a high flow rate for the opposite direction of travel before the motor changes rotational directions. Such change or shock can result in uncomfortable operation of the power machine for the operator in addition to potential damage to components.

The discussion above is merely provided for general background information and is not intended to be used as an aid in determining the scope of the claimed subject matter.

SUMMARY

This Summary and the Abstract are provided to introduce a selection of concepts in a simplified form that are further described below in the Detailed Description. This Summary is not intended to identify key features or essential features of the claimed subject matter.

In some exemplary embodiments, a travel motor hydraulic circuit is provided for controlling the provision of hydraulic fluid to a travel motor. The travel motor hydraulic circuit includes a counterbalance valve configured to block the flow of hydraulic fluid when in a neutral position to prevent unintended movement of a power machine. The travel motor hydraulic circuit also includes an anti-cavitation valve configured to direct flow of hydraulic fluid back to the travel motor to prevent cavitation.

In some exemplary embodiments, the output of the anti-cavitation valve is coupled on the downstream sides of check valves to input passages of the travel motor to prevent a condition in which a commanded change in direction of the travel motor causes hydraulic fluid to temporarily bypass the travel motor before the hydraulic circuit reaches steady state. This prevents a flow of hydraulic fluid from bypassing the travel motor until the anti-cavitation valve has shifted in response to the commanded change of direction of the travel motor.

In some embodiments, a power machine includes a frame, a power source supported by the frame, and a hydraulic system operably coupled to the power source for driving the machine. The hydraulic system includes a hydraulic pump, a drive motor capable of receiving pressurized fluid to operate in one of a first direction and second direction, and a control valve. The control valve is in communication with the hydraulic pump and configured to selectively provide pressurized hydraulic fluid to the first port of the drive motor in a first control valve position and to the second port of the drive motor in a second control valve position. The drive motor has a first port for receiving pressurized fluid to operate in the first direction and a second port for receiving pressurized fluid to operating in the second direction. When the drive motor receives the pressurized fluid at the first port, a return flow of pressurized fluid is returned via the second port. When the drive motor receives the pressurized fluid at the second port the return flow of the pressurized fluid is returned via the first port. A counterbalance valve is operable to receive selectively receive the return flow from the drive motor and allow flow to pass therethrough. An anti-cavitation valve is operable to selectively receive flow from the counterbalance valve and allow flow to pass therethrough. A first restriction is positioned between the control valve and the drive motor. A portion of the flow received by and passed through the anti-cavitation valve is directed to a node positioned between the first restriction and the drive motor so that the flow bypasses the first restriction and is provided to the drive motor. The first restriction can be a check valve.

In some embodiments, the counterbalance valve is biased to a blocking position and wherein pressurized fluid provided to the drive motor causes the counterbalance valve to shift from the blocking position to an open position to allow flow to pass therethrough. Likewise, in some embodiments, the anti-cavitation valve is biased to a blocking position and wherein pressurized fluid provided to the drive motor causes the anti-cavitation valve to shift from the blocking position to an open position to allow flow to pass therethrough. In some embodiments, a first biasing force is provided to bias the counterbalance valve to the blocking position and a second biasing force is provided to bias the anti-cavitation valve and wherein the first biasing force is lower than the second biasing force.

In some embodiments, a second restriction is located between the control valve and the drive motor. The first restriction is located between the control valve and the first port of the motor and the second restriction is located between the control valve and the second port of the motor. When the control valve is in the first position, a portion of the flow received by and passed through the anti-cavitation valve is directed to a node positioned between the first restriction and the drive motor so that the flow bypasses the first restriction and is provided to the first port of the drive motor. When the control valve is in the second position, a portion of the flow received by and passed through the anti-cavitation valve is directed to a node positioned between the second restriction and the drive motor so that the flow bypasses the second restriction and is provided to the second port of the drive motor.

In some embodiments, a hydraulic circuit for a drive system on a power machine, a hydraulic drive pump and a drive motor capable of receiving pressurized fluid to operate in one of a first direction and second direction. The drive motor has a first port for receiving pressurized fluid to operate in the first direction and a second port for receiving pressurized fluid to operating in the second direction. When the drive motor receives the pressurized fluid at the first port a return flow of pressurized fluid is returned via the second port and wherein when the drive motor receives the pressurized fluid at the second port the return flow of the pressurized fluid is returned via the first port. The first valve is operable to selectively receive the return flow from the drive motor. A first restriction is positioned between the hydraulic drive pump and the drive motor. A portion of the flow received by and passed through the first valve is directed to a node positioned between the first restriction and the drive motor so that the flow bypasses the first restriction and is provided to the drive motor.

In some embodiments, the hydraulic circuit includes a control valve is in communication with the hydraulic drive pump and configured to selectively direct pressurized hydraulic fluid to the first port of the drive motor in a first control valve position and to the second port of the drive motor in a second control valve position. In some embodiments, a second restriction is positioned between the hydraulic drive pump and the drive motor. When the control valve directs pressure to the second port, a portion of the flow received by and passed through the first valve is directed to a node positioned between the second restriction and the drive motor so that the flow bypasses the second restriction and is provided to the drive motor.

In some embodiments, when the control valve moves from the first control valve position to the second control valve position, flow from the node positioned between the first restriction and the drive motor is provided, through the first valve, to the node positioned between second restriction and the drive motor and flow from the first valve is prevented from being returned to the control valve until the first valve has shifted.

DRAWINGS

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments address issues of providing hydraulic fluid from a power machine's hydraulic system, for example in an excavator, to a travel motor while limiting cavitation and providing other features such as hydraulic braking. In some embodiments, a travel motor hydraulic circuit includes an anti-cavitation valve coupled between input ports which provide hydraulic fluid to the travel motor to ensure sufficient hydraulic fluid is provided to the travel motor under certain conditions to prevent cavitation of the pump. Further, in some embodiments, a counterbalance valve is also coupled between the inputs to the travel motor and is configured to provide a hydraulic braking function to prevent unintended flow of hydraulic fluid through the travel motor, and corresponding movement of the power machine, when the operator inputs are in a neutral position.

To prevent a condition in which a commanded change in direction of the travel motor causes hydraulic fluid to temporarily bypass the travel motor before the hydraulic circuit reaches steady state, in some embodiments, the output of the anti-cavitation valve is coupled on the downstream sides of check valves to the inputs of the travel motor. This prevents flow of hydraulic fluid through the anti-cavitation valve, and corresponding bypassing of the travel motor, until the anti-cavitation valve has shifted in response to the commanded change of direction of the travel motor.

Figure 2:
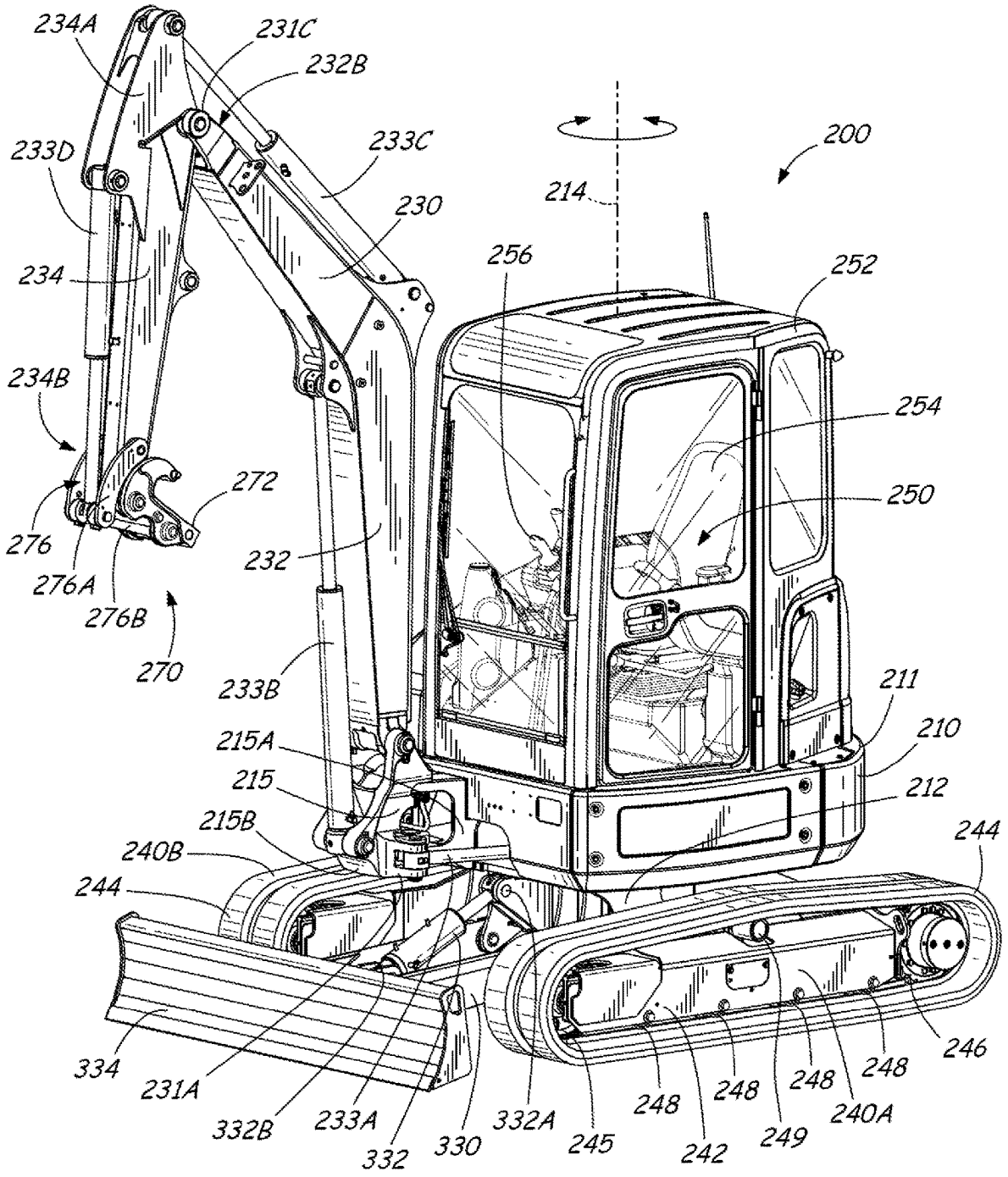
FIG. 2 is a front left perspective view of a representative power machine in the form of an excavator on which the disclosed embodiments can be practiced.
Figure 3:
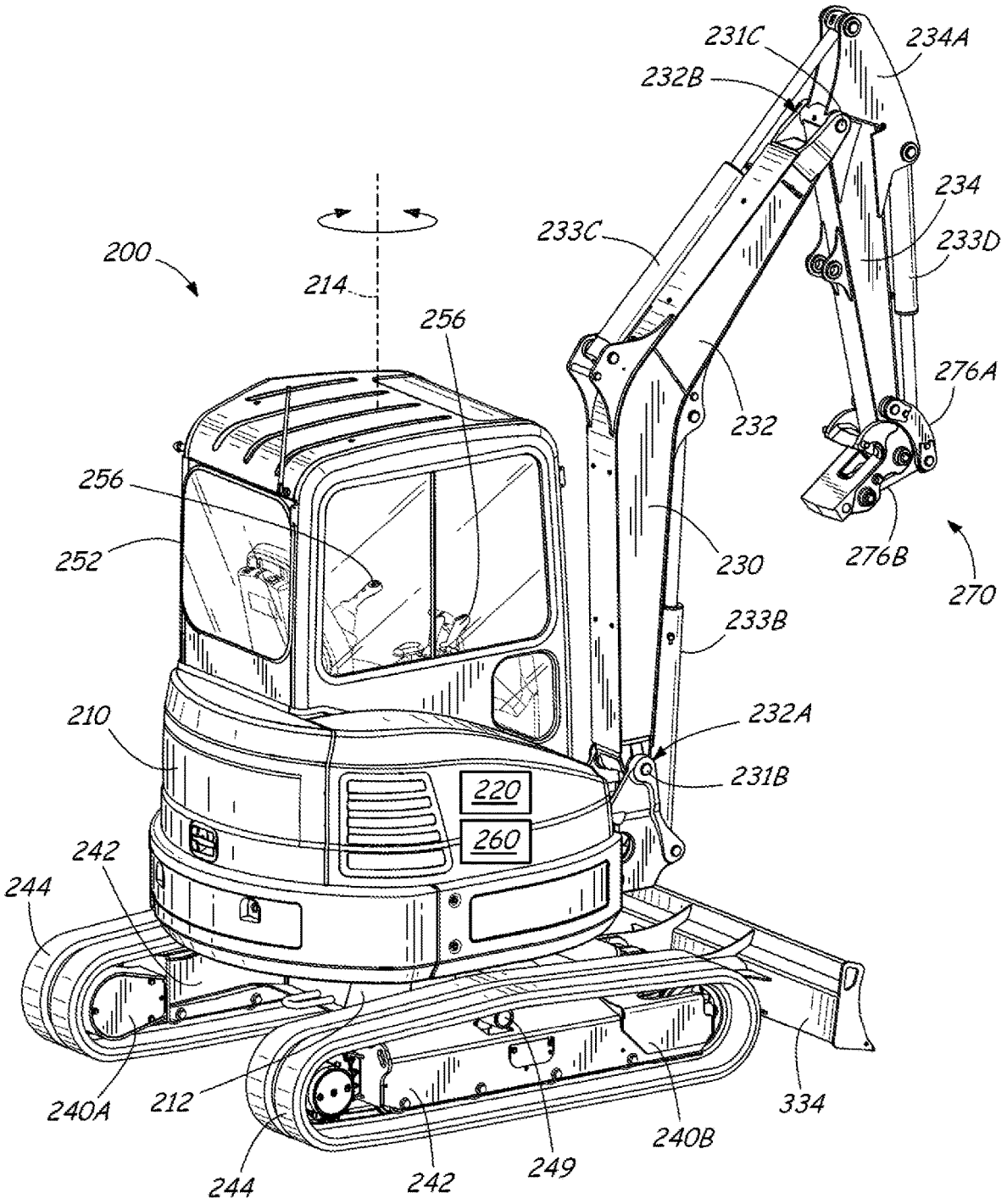
FIG. 3 is a rear right perspective view of the excavator of FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

Figure 1:
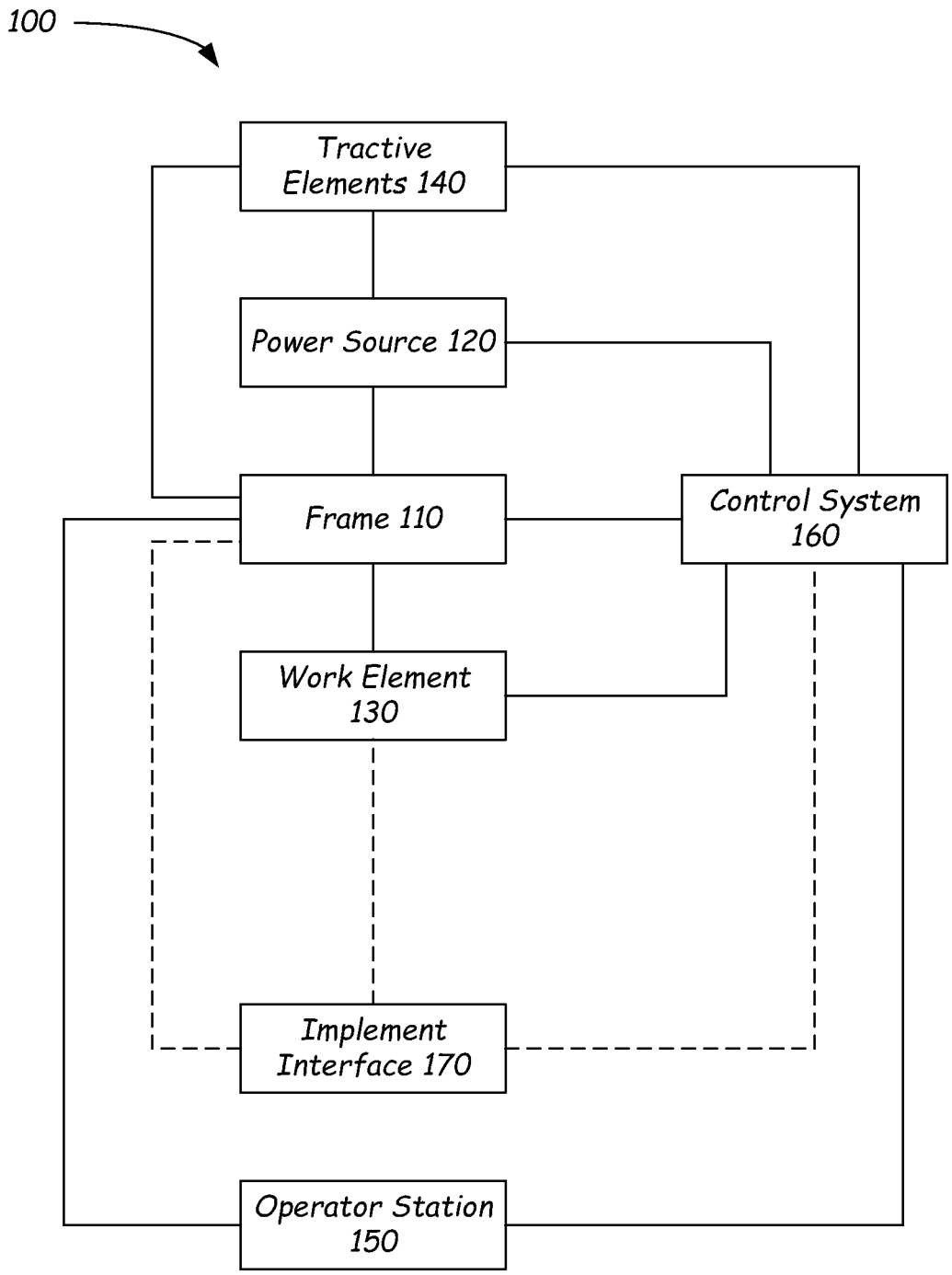
FIG. 1 is a block diagram illustrating functional systems of a representative power machine on which embodiments of the present disclosure can be practiced.

Referring now to FIG. 1, a block diagram illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are capable of performing a dedicated task. For example, some work vehicles have a lift arm to which an implement such as a bucket is attached such as by a pinning arrangement. The work element, i.e., the lift arm can be manipulated to position the implement for the purpose of performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates about a swivel with respect to a lower frame portion. Other work vehicles have articulated frames such that one portion of the frame pivots with respect to another portion for accomplishing steering functions. In exemplary embodiments, at least a portion of the power source is located in the upper frame or machine portion that rotates relative to the lower frame portion or undercarriage. The power source provides power to components of the undercarriage portion through the swivel.

Frame 110 supports the power source 120, which is capable of providing power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote control device can be provided (i.e. remote from both of the power machine and any implement to which is it coupled) that is capable of controlling at least some of the operator controlled functions on the power machine.

FIGS. 2-3 illustrate an excavator 200, which is one particular example of a power machine of the type illustrated in FIG. 1, on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all of the features or be limited to the features that excavator 200 has. Excavator 200 has a frame 210 that supports and encloses a power system 220 (represented in FIGS. 2-3 as a block, as the actual power system is enclosed within the frame 210). The power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260 is provided for controlling the various work elements. Control system 260 includes operator input devices, which interact with the power system 220 to selectively provide power signals to actuators to control work functions on the excavator 200.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion 232, known generally as a boom, and a second portion 234, known as an arm or a dipper. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that is capable of accepting and securing a variety of different implements to the lift arm 230. Such implements have a machine interface that is configured to be engaged with the implement carrier 272. The implement carrier 272 is pivotally mounted to the second end 234B of the arm 234. An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source.

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and preventing the track from rubbing on track frame 242.

A second, or lower, lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm 230, the lower lift arm 330, the traction system 240, pivoting the house 211, the tractive elements 240, and so forth.

Excavator 200 provides a variety of different operator input devices 256 to control various functions. For example, hydraulic joysticks are provided to control the lift arm 230, and swiveling of the house 211 of the excavator. Foot pedals with attached levers are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and excavator 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on an excavator such as excavator 200, unless otherwise noted, the concepts discussed below are not intended to be limited in their application to the environments specifically described above.

Figure 4:
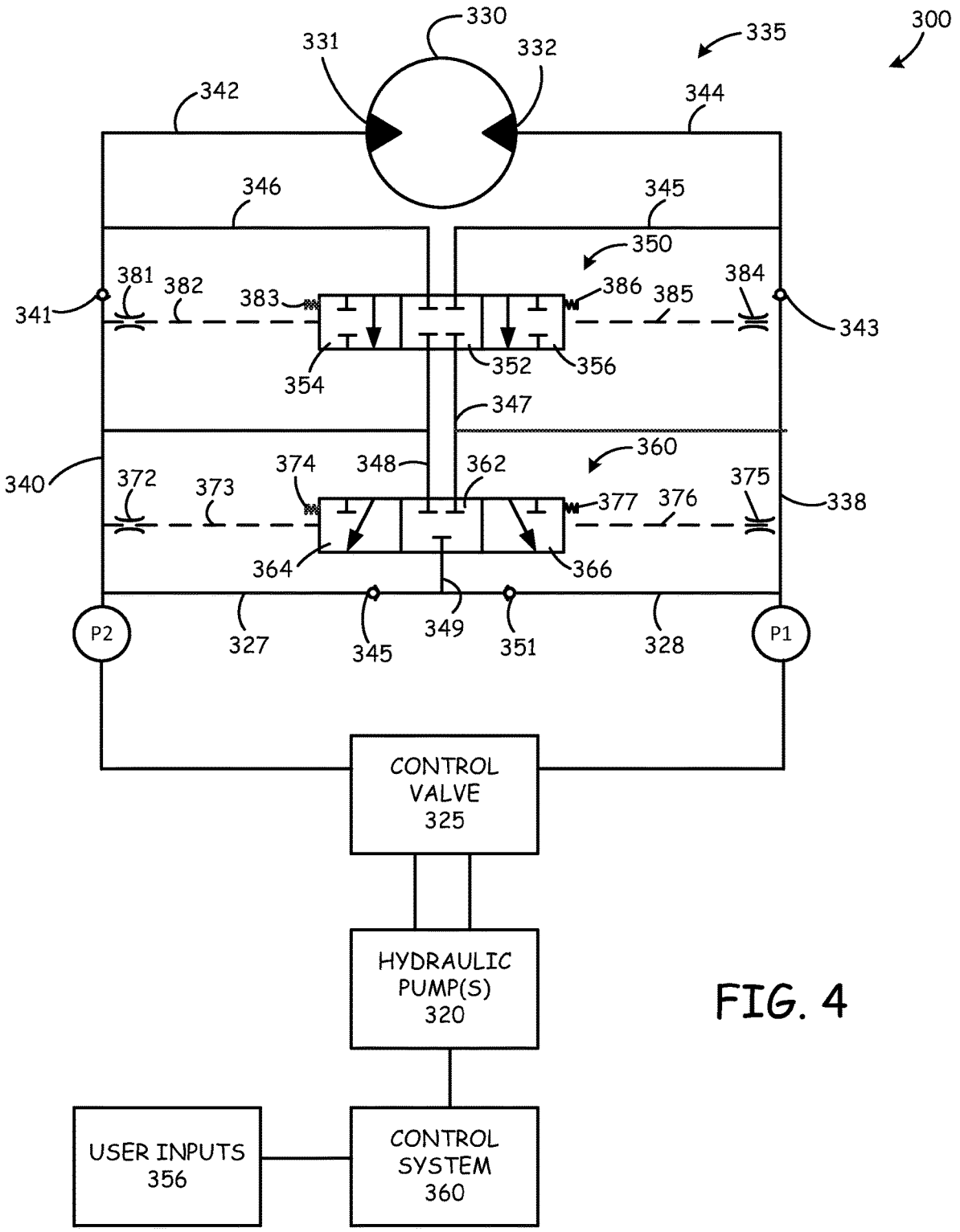
FIG. 4 is a diagrammatic illustration of a portion of a power machine showing a travel motor and a travel motor hydraulic circuit in accordance with some exemplary embodiments.

FIG. 4 illustrates portions of a power machine 300, which can be a power machine similar to power machines 100 and 200 described above and further illustrating embodiments of the present discussion. Although only certain components of power machine 300 are shown for illustrative purposes, power machine 300 can include other components such as those described above with reference to FIGS. 1-3. As shown, power machine 300 includes a travel motor 330, a travel motor hydraulic circuit 335 configured to control the provision of hydraulic fluid to travel motor 330, a control valve 325 that couples travel motor hydraulic circuit 335 to one or more hydraulic pumps 320, a control system 360 and user inputs 356. Based upon positions of user inputs 356, which can be, for example, one or more travel levers, a control system 360 controls hydraulic pumps and/or control valve 325 to control the flow rate and direction of flow of hydraulic fluid to first and second ports P1 and P2 of travel motor hydraulic circuit 335. While a single travel motor 330 and travel motor hydraulic circuit 335 are shown, in some exemplary embodiments power machine 300 will include separate travel motors and travel motor hydraulic circuits to control tractive elements on the left and right sides of the machine. In such embodiments, the second travel motor and travel motor hydraulic circuit (and as may be the case, additional travel motors and hydraulic circuits) can be the same as, or similar to, those shown in FIG. 4.

A first hydraulic circuit port P1 is coupled to first travel motor port 332 of travel motor 330 through conduit 338, check valve 343, and conduit 344. A second hydraulic circuit port P2 is coupled to second travel motor port 331 of travel motor 330 through conduit 340, check valve 341, and conduit 342. When an operator commands movement of power machine 300 in a first direction, for example a forward direction using user inputs 356, control valve 325 provides a flow of pressurized hydraulic fluid to port or passage P1. For purposes of this discussion, the terms port and passage can be used interchangeably and refer to an opening through which a fluid can flow. The pressurized hydraulic fluid flows through conduit 338, check valve 343, and conduit 344 to port 332 of travel motor 330. The hydraulic fluid exits travel motor 330 at port 331 and conduit 342. Check valve 341 blocks the flow of pressurized hydraulic fluid directly through conduit 340 into port or passage P2, and instead requires that the hydraulic fluid exiting travel motor 330 pass through conduit 346 and through one or both of a counterbalance valve 350 and an anti-cavitation valve 360, which in some embodiments is a spool valve using the configurations described below with reference to FIGS. 5 and 6. When the operator commands movement of the power machine in the opposite direction, for example in a rearward direction, control valve 325 instead provides pressurized hydraulic fluid to port P2 where it is provided to port 331 of travel motor 330 through conduit 340, check valve 341, and conduit 342. Hydraulic fluid exiting travel motor 330 at port 332 into conduit 344 is similarly blocked by check valve 343, and must travel through one or both of counterbalance valve 350 and anti-cavitation valve 360 via conduit 345 as will be described below in greater detail.

In an exemplary embodiment, counterbalance valve 350 is a three-position spool valve having a neutral position 352 and first and second actuated positions 354 and 356, and is configured to block the flow of hydraulic fluid through travel motor 330 when in its neutral position 352 to provide a hydraulic braking function. In the absence of pressurized hydraulic fluid provided to one of ports P1 and P2, bias mechanisms 383 and 386 maintain counterbalance valve 350 in neutral position 352. Counterbalance valve 350 is also in communication with conduit 340 through a flow restricting orifice 381 and a conduit 382, and with conduit 338 through a flow restricting orifice 384 and a conduit 385. The connections of counterbalance valve 350 to each of conduits 338 and 340 allows counterbalance valve 350 to be shifted to one of actuated positions 354 and 356 when movement of the power machine is commanded by the operator and pressurized hydraulic fluid is correspondingly provided to one of ports P1 and P2. In a steady state condition, when pressurized hydraulic fluid is provided to port P1, counterbalance valve 350 will shift to actuated position 356 as shown in FIG. 6. When pressurized fluid is provided to port P2, counterbalance valve 350 will shift to actuated position 354 as shown in FIG. 5.

Anti-cavitation valve 360 similarly includes a neutral position 362 and first and second actuated positions 364 and 366. In the absence of pressurized hydraulic fluid being provided to either of ports P1 and P2, anti-cavitation valve 360 is maintained in neutral position 362 by bias mechanisms 374 and 377. Like counterbalance valve 350, to move anti-cavitation valve 360 between the first and second actuated positions 364 and 366, valve 360 is also coupled to conduit 340 through a flow restricting orifice 372 and a conduit 373, and to conduit 338 through a flow restricting orifice 375 and a conduit 376. Anti-cavitation valve 360 shifts between actuated positions 364 and 366 in the same manner as described above regarding counterbalance valve 350, and the actuated positions of anti-cavitation valve 360 are shown in FIGS. 5 and 6. Conduits 347 and 348 couple output ports of counterbalance valve 350 to input ports of anti-cavitation valve 360, and also to conduits 338 and 340. Conduit 349 couples an output port of anti-cavitation valve 360 to port P1 through check valve 351 and conduit 328 and to port P2 through check valve 345 and conduit 327. Fluid drawn through check valve 351 serves to prevent cavitation of motor 330 in some conditions when the anti-cavitation valve is positioned as shown in FIG. 6. Likewise, fluid drawn through check valve 345 serves to prevent cavitation of motor 330 in some conditions when the anti-cavitation valve is positioned as shown in FIG. 5.

Figure 5:
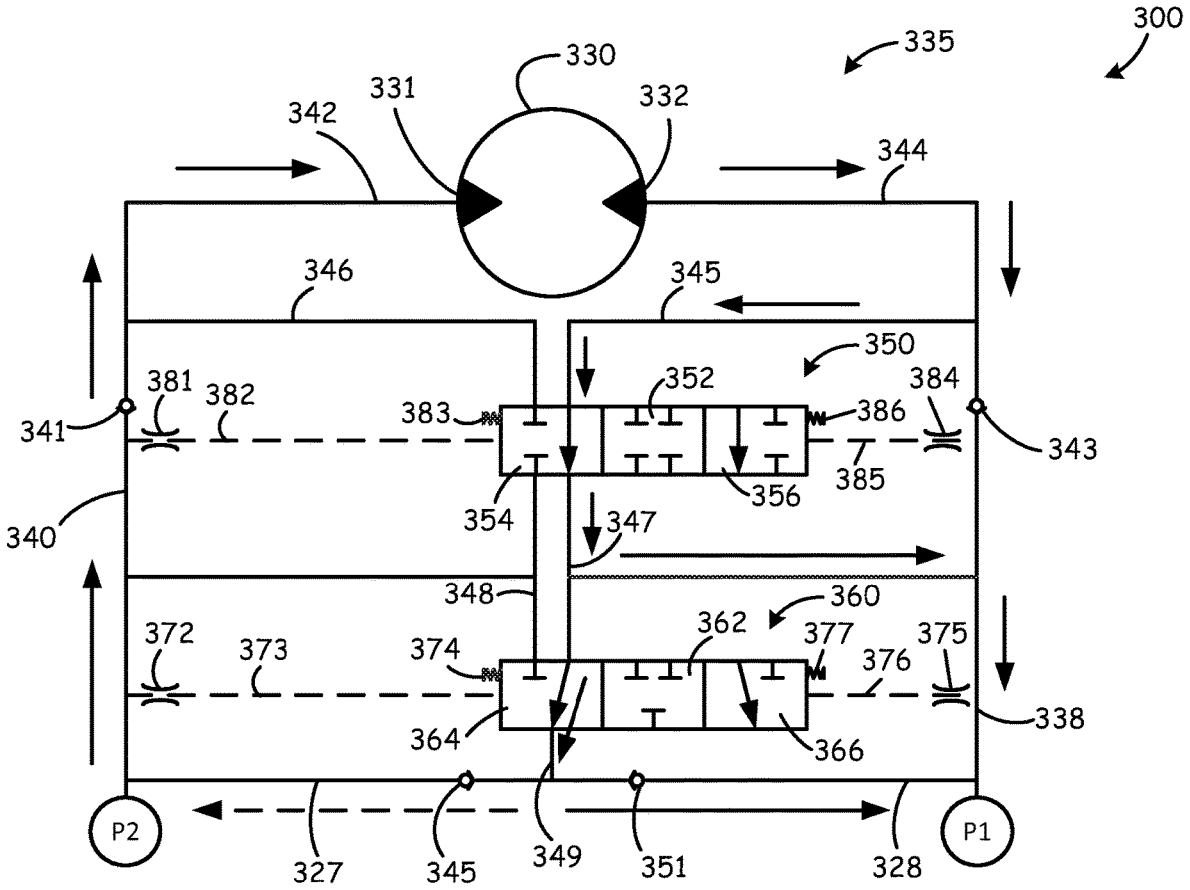
FIG. 5 is a simplified schematic diagram of the travel motor hydraulic circuit, shown in FIG. 4, in a first steady state condition with hydraulic fluid provided to the travel motor in a first direction.
Figure 6:
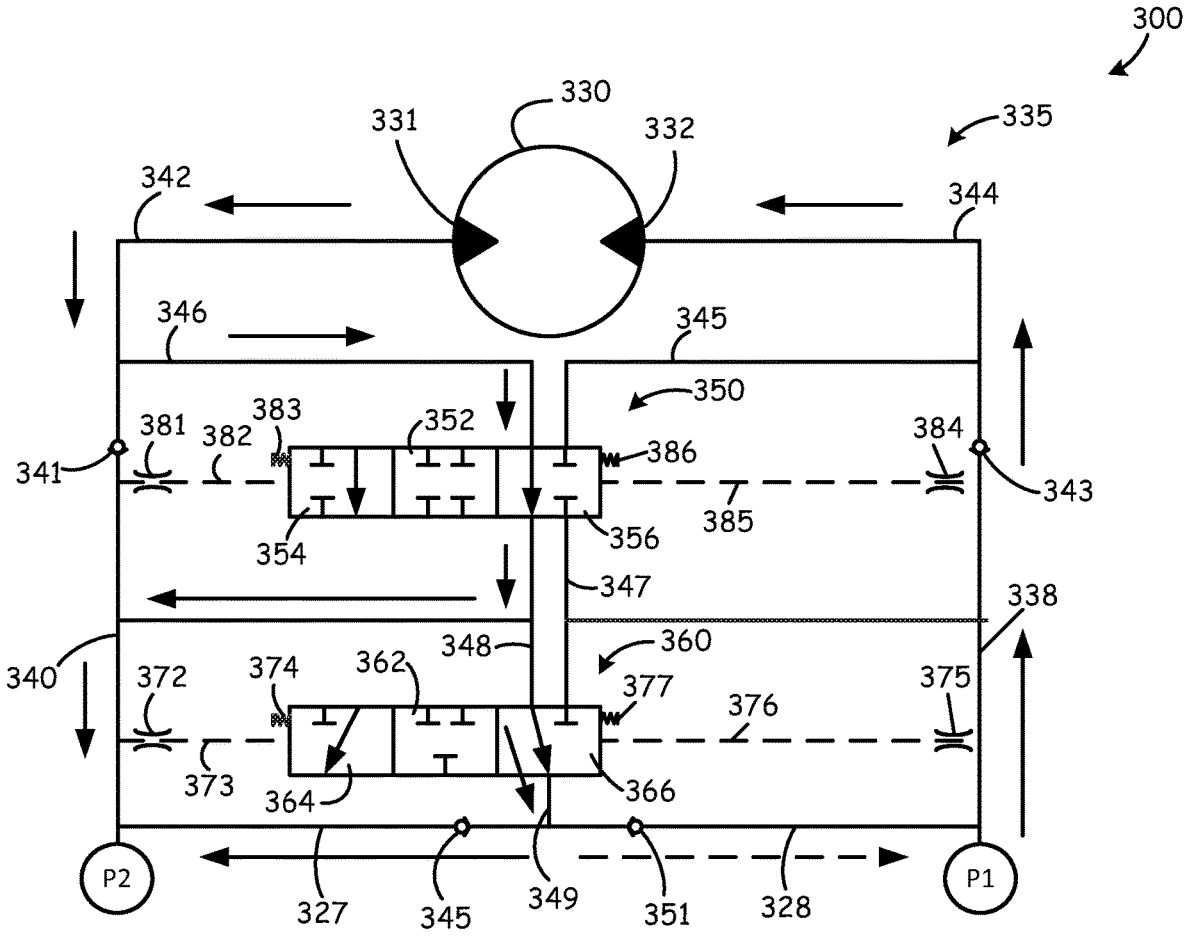
FIG. 6 is a simplified schematic diagram of the travel motor hydraulic circuit, shown in FIG. 4, in a second steady state condition with hydraulic fluid provided to the travel motor in a second direction.

Referring now to FIG. 5, shown are flow paths of hydraulic fluid when an operator has commanded travel motor 330 such that pressurized hydraulic fluid is provided to circuit 335 at port P2, and when circuit 335 has reached a steady state condition. Under the steady state condition, pressurized hydraulic fluid entering port P2 into conduit 340 moves counterbalance valve 350 and anti-cavitation valve 360 to the right and into actuated positions 354 and 364. In these positions, pressurized hydraulic fluid flows, as shown with solid line arrows, through check valve 341 and conduit 342 into port 331 of travel motor 330. Hydraulic fluid exiting port 332 of travel motor 330 flows through conduits 344 and 345 and into counterbalance valve 350. Hydraulic fluid exiting counterbalance valve 350 travels through conduits 347 and 338 and out of port P1. Further, some of the hydraulic fluid exiting of counterbalance valve 350 can instead flow through anti-cavitation valve 360. The hydraulic fluid exiting anti-cavitation valve 360 flows through conduit 349, check valve 351 and conduit 328 to port P1. In a condition in which pressure in conduit 327 is lower than pressure in conduit 349, some hydraulic fluid can flow through check valve 345 to conduit 327 back to port P2 to prevent motor cavitation, as shown by dashed arrows.

Referring now to FIG. 6, shown is travel motor hydraulic circuit 335 in a steady state condition when the operator has commanded a machine travel direction which causes hydraulic fluid to flow into port P1. As shown in FIG. 6, with pressurized hydraulic fluid provided to conduit 338, counterbalance valve 350 and anti-cavitation valve 360 each shift to the left and into actuated positions 356 and 366. In these positions, pressurized hydraulic fluid flows through circuit 335 along paths as shown by the solid line arrows. As such, pressurized hydraulic fluid flowing into port P1 flows through conduit 338, check valve 343 and conduit 344 before entering port 332 of travel motor 330. Hydraulic fluid exiting port 331 of travel motor 330 travels through conduits 342 and 346 to counterbalance valve 350. Hydraulic fluid exiting counterbalance valve 350 flows through conduits 348 and 340 before exiting port P2. As was the case with the steady state condition discussed above with reference to FIG. 5, some of the hydraulic fluid exiting counterbalance valve 350 can also flow through anti-cavitation valve 360. This hydraulic fluid flowing through anti-cavitation valve 360 then flows through conduit 349, check valve 345 and conduit 327 before exiting port P2, or through check valve 351 and conduit 328 where it is provided to port P1 to prevent cavitation.

Figure 7:
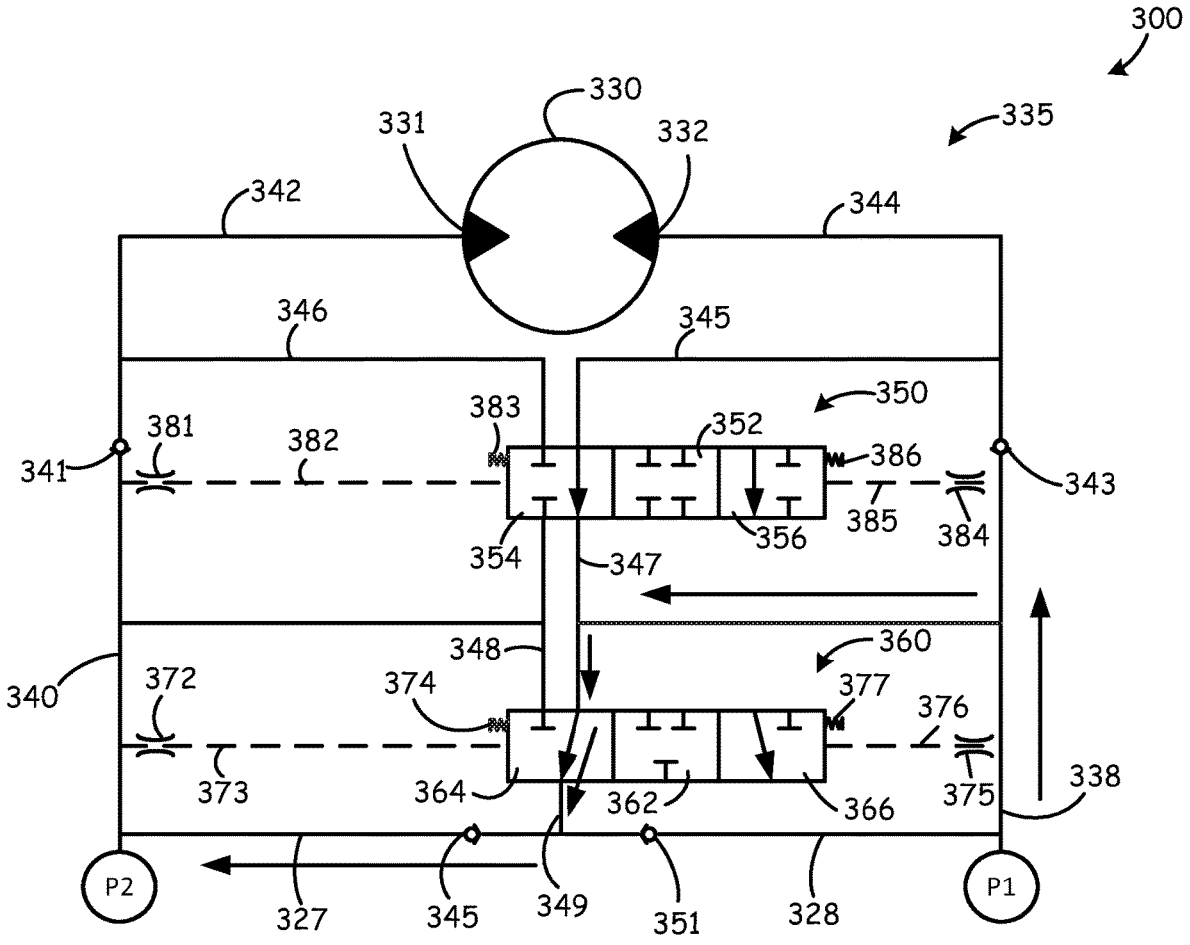
FIG. 7 is a simplified schematic diagram of the travel motor hydraulic circuit, shown in FIG. 4, in a condition in which a change in the commanded direction of the travel motor has occurred, but in which the circuit has not reached steady state and hydraulic fluid bypasses the travel motor.

While FIGS. 5 and 6 illustrate circuit 335 operating under steady state conditions, in some embodiments, immediately after the operator has commanded a change in direction of the travel motor, a condition can exist where hydraulic fluid bypasses travel motor 330. For example, FIG. 7 illustrates circuit 335 in such a condition immediately after the flow of pressurized hydraulic fluid has changed from entering port P2 to entering port P1. Before valves 350 and 360 have shifted to actuated positions 356 and 366, they remain in actuated positions 354 and 364. This temporarily presents a flow path of hydraulic fluid, as represented by solid line arrows, directly through anti-cavitation valve 360 and back to port P2 without having passed through travel motor 330. This condition will persist and travel motor 330 will not change directions until valve 360 shifts to neutral position 362 or activated position 366, resulting in a lack of responsiveness to the operator command. Further, when the valve 360 does shift, the change of direction of travel motor 330 can happen abruptly, causing a shock to the travel motor, hydraulic system components, and power machine, resulting in an uncomfortable ride for an operator and potentially damaging components on the power machine.

Figure 8:
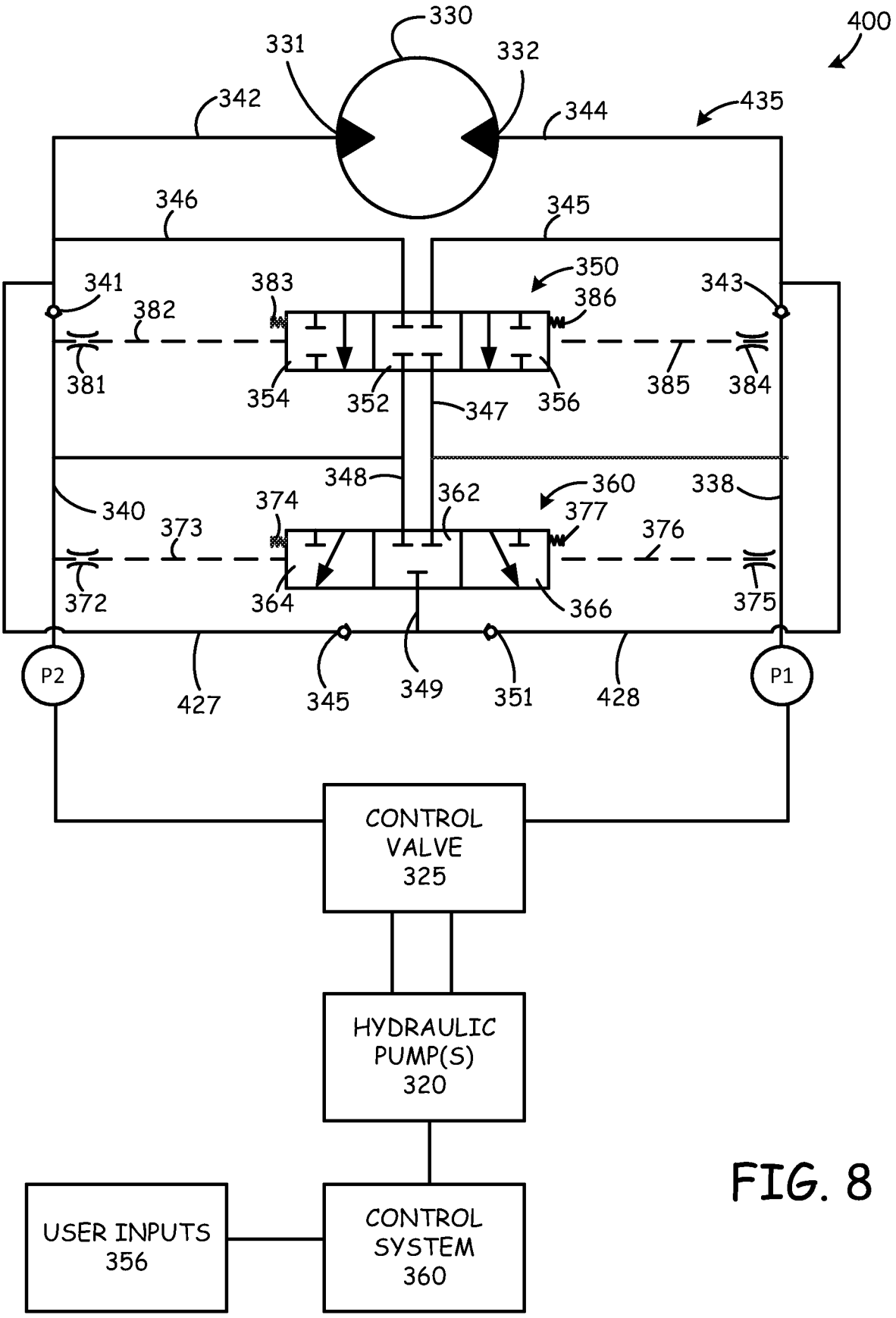
FIG. 8 is a simplified schematic diagram of a portion of a power machine showing a travel motor and a travel motor hydraulic circuit in accordance with some further exemplary embodiments.

To overcome the above-discussed phenomena of the anti-cavitation valve 360 providing a flow path for hydraulic fluid to exit the circuit before being provided to travel motor 330, in some embodiments, an alternate travel motor hydraulic circuit is provided. FIG. 8 illustrates portions of a power machine 400 having a travel motor hydraulic circuit 435. Power machine 400 and travel motor circuit 435 are identical to power machine 300 and travel motor hydraulic circuit 335, with the exception of connection of the output of anti-cavitation valve 360 to ports P1 and P2. As shown in FIG. 8, in travel motor hydraulic circuit 435, instead of conduits 327 and 328 coupling the output of valve 360 to ports P1 and P2, conduits 427 and 428 are provided which couple the output of valve 360 to downstream sides of check valves 341 and 343. As illustrated, conduit 349 again couples the output of anti-cavitation valve 360 to check valves 345 and 351. However, conduits 427 and 428 do not provide a direct flow path of hydraulic fluid back out of the exiting port. Instead, in hydraulic circuit 435, the output of anti-cavitation valve 360 is provided more directly to motor 330 so that in a transition, pressurized hydraulic fluid must pass through the motor 330 and the counterbalance valve 350 before returning to the control valve 325 instead of bypassing the motor.

Figure 9:
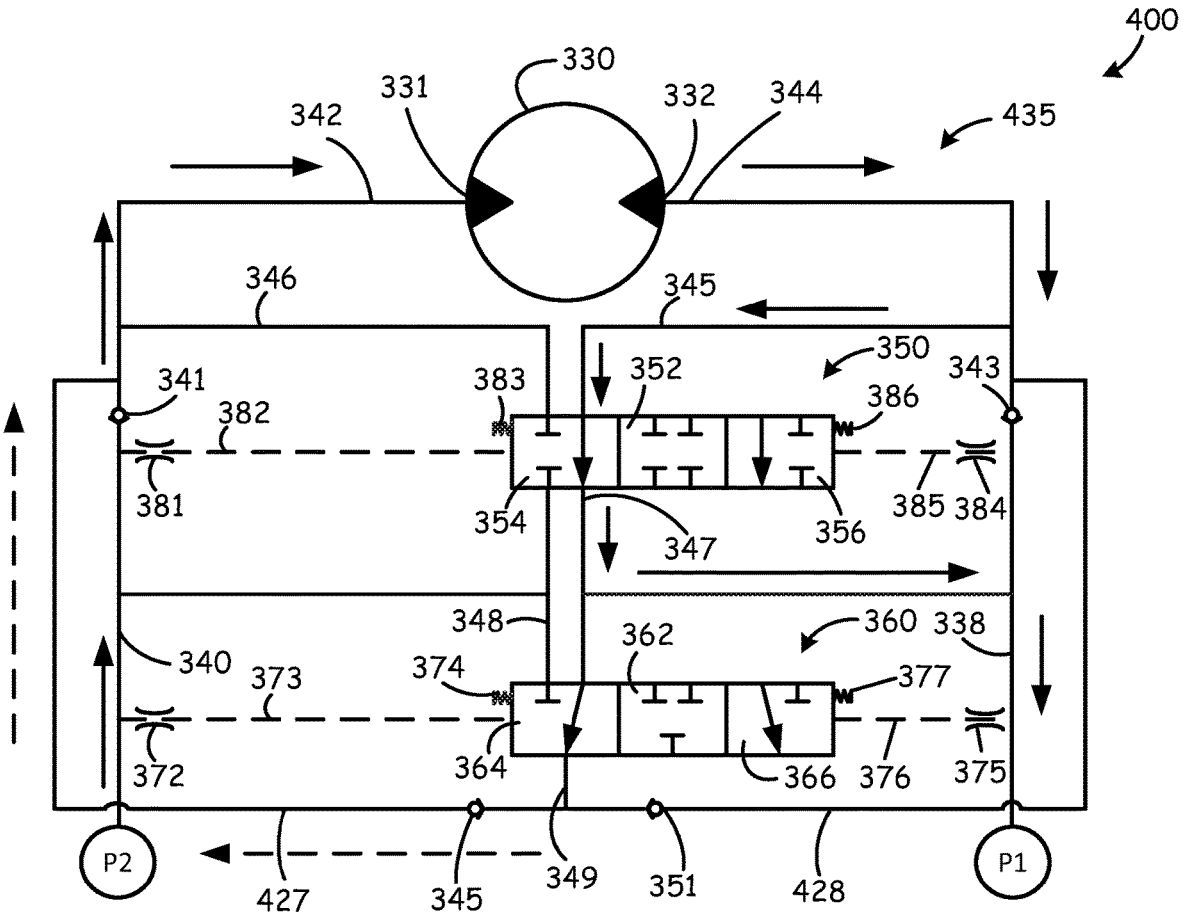
FIG. 9 is a simplified schematic diagram of the travel motor hydraulic circuit, shown in FIG. 8, in a first steady state condition with hydraulic fluid provided to the travel motor in a first direction.
Figure 10:
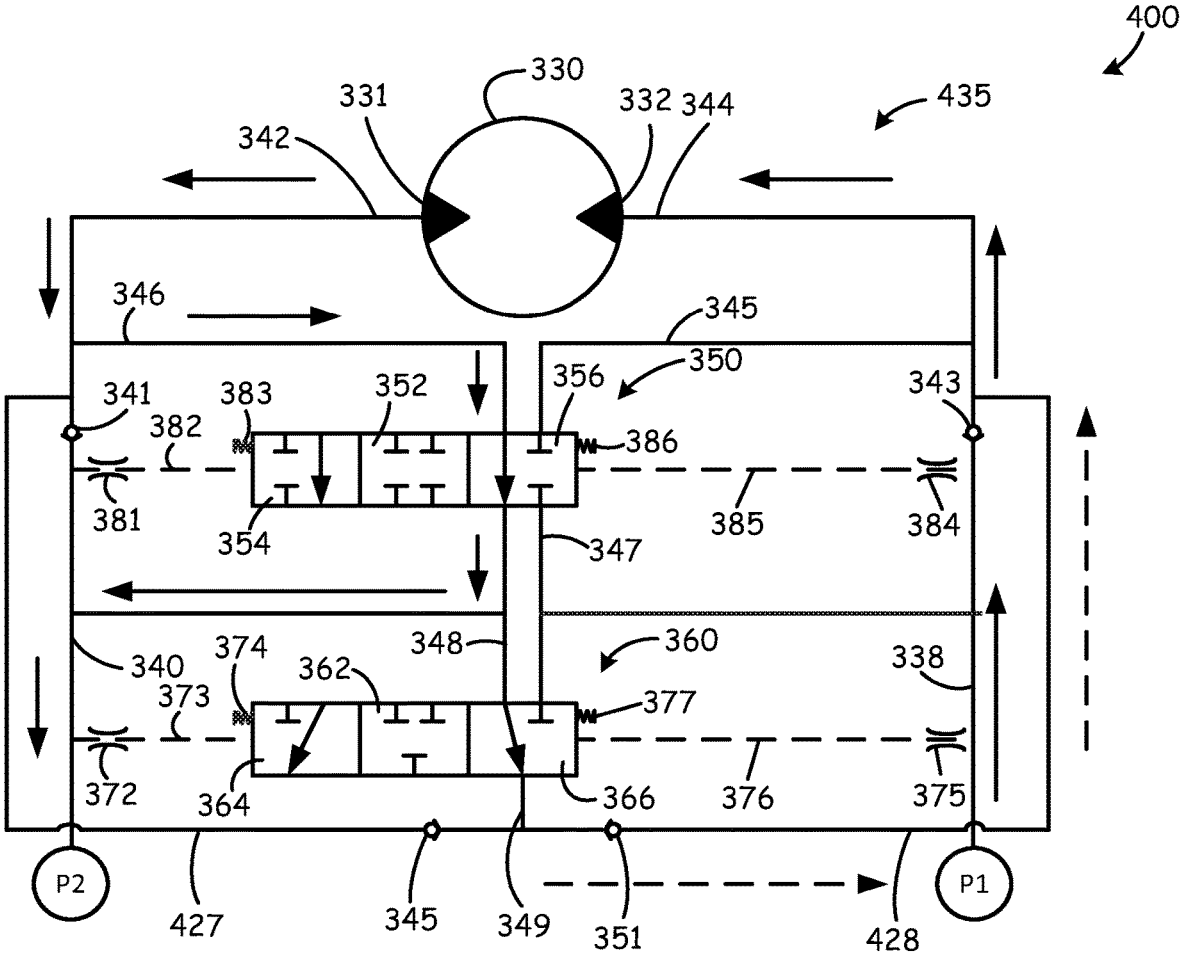
FIG. 10 is a simplified schematic diagram of the travel motor hydraulic circuit, shown in FIG. 8, in a second steady state condition with hydraulic fluid provided to the travel motor in a second direction.

Referring now to FIG. 9, shown are flow paths of hydraulic fluid in travel motor hydraulic circuit 435 in a first steady state condition with hydraulic fluid entering through port P2. As was the case with travel motor hydraulic circuit 335 shown in FIG. 5, in this steady state condition, counterbalance valve 350 and anti-cavitation valve 360 will have shifted to the right into actuated positions 354 and 364. The flow of hydraulic fluid through circuit 435 will be substantially the same as the flow of hydraulic fluid through circuit 335, as represented by solid line arrows in FIG. 9. Dashed line arrows again represent the flow of hydraulic fluid in circuit 435 when necessary to prevent cavitation. Similarly, FIG. 10 illustrates travel motor hydraulic circuit 435 in a steady state condition, similar to that discussed above with reference to FIG. 6, with pressurized hydraulic fluid entering port P1. Again, the flow paths of hydraulic fluid through circuit 435 are substantially the same as discussed above with reference to circuit 335 and FIG. 6. The dashed line arrows again represent the flow of hydraulic fluid in the circuit when required to prevent cavitation.

Figure 11:
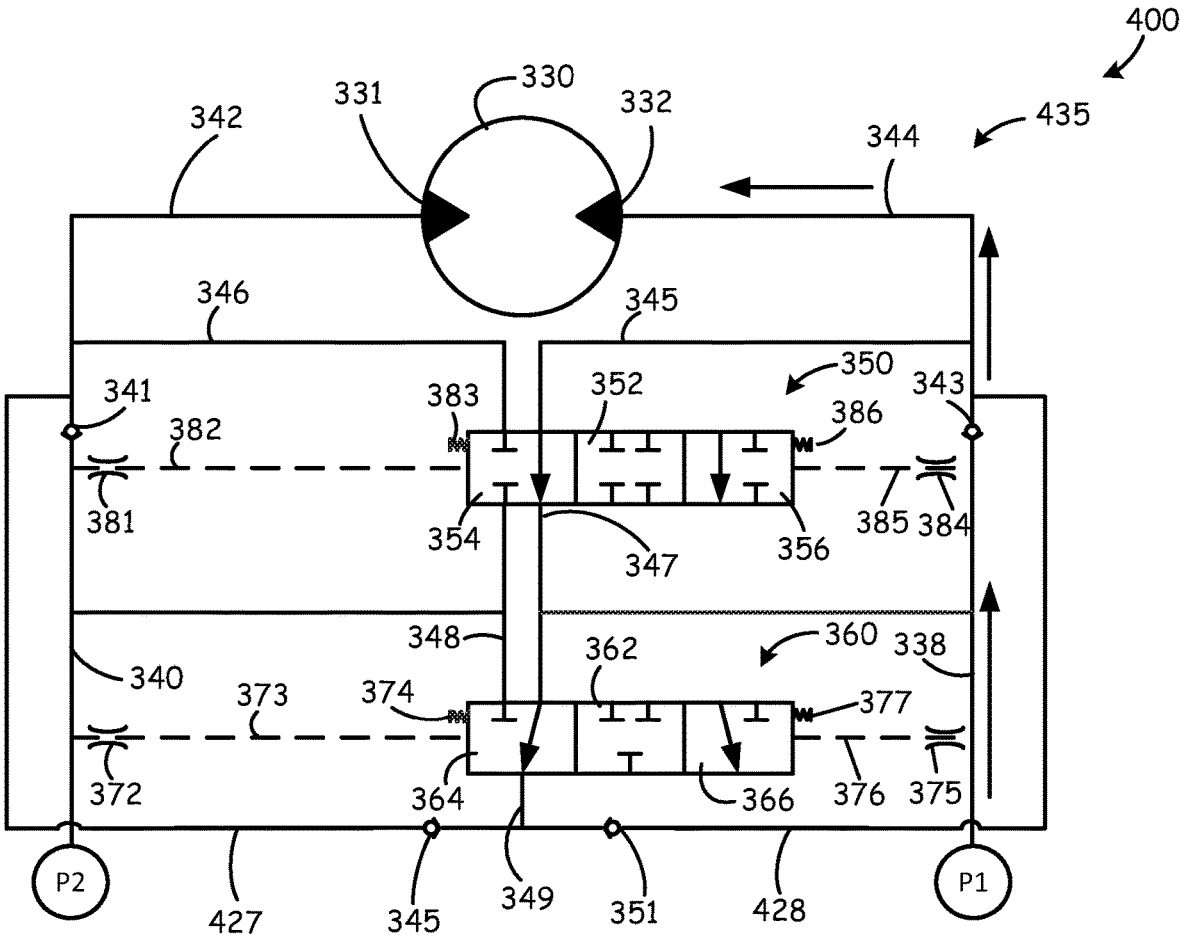
FIG. 11 is a simplified schematic diagram of the travel motor hydraulic circuit, shown in FIG. 8, in a condition in which a change in the commanded direction of the travel motor has occurred, but in which the circuit has not reached steady state.

FIG. 11 illustrates travel motor hydraulic circuit 435 in a condition similar to that discussed above with reference to FIG. 7 for travel motor hydraulic circuit 335 immediately after the operator has commanded a change in direction of the travel motor. In this condition, valves 350 and 360 have not yet shifted to actuated positions 356 and 366. However, due to the output of anti-cavitation valve 360 being connected to downstream sides of check valves 341 and 343, hydraulic fluid does not bypass motor 330 by exiting hydraulic circuit 435 through port P2, but is fed back to the motor 330 as described above, allowing pressure in conduit 338 to build up and cause valves 350 and 360 to shift to actuated positions 356 and 366 quickly because hydraulic fluid cannot exit through port P2 and thus pressure will build. This is clear from FIG. 11 since hydraulic fluid from conduit 346 is blocked when 350 is in position 354. This results in increased motor responsiveness and reduced shock to the system.

Although the present invention has been described with reference to preferred embodiments, workers skilled in the art will recognize that changes may be made in form and detail without departing from the scope of the discussion. For example, it must be understood that the travel motor hydraulic circuits are represented in simplified form for illustrative purposes. As such, those of skill in the art will recognize that the hydraulic circuits can include additional or different components. Further, while the disclosed counterbalance valve and anti-cavitation valve are shown as three position spool valves, in other embodiments these valves can be four position spool valves or have other configurations. Other such changes to the hydraulic circuits are within the scope of the disclosed embodiments.

What is claimed is:

1. A power machine, comprising:

a frame:

a power source supported by the frame; and a hydraulic system operably coupled to the power source for driving the machine, the hydraulic system including:

a hydraulic pump;

a drive motor capable of receiving pressurized fluid to operate in one of a first direction and second direction, the drive motor having a first port for receiving the pressurized fluid to operate in the first direction and a second port for receiving the pressurized fluid to operate in the second direction, wherein when the drive motor receives the pressurized fluid at the first port a return flow of the pressurized fluid is returned via the second port and wherein when the drive motor receives the pressurized fluid at the second port the return flow of the pressurized fluid is returned via the first port;

a control valve in communication with the hydraulic pump and configured to selectively provide pressurized hydraulic fluid to the first port of the drive motor in a first control valve position and to the second port of the drive motor in a second control valve position;

a counterbalance valve operable to selectively receive the return flow from the drive motor and allow flow to pass therethrough;

an anti-cavitation valve operable to selectively receive the flow from the control valve via the counterbalance valve and allow the flow to pass therethrough;

a first restriction positioned between the control valve and the drive motor; and wherein a portion of the flow received by and passed through the anti-cavitation valve is directed to a first node positioned between the first restriction and the drive motor so that the flow bypasses the first restriction and is provided to the drive motor.

2. The power machine of claim 1, wherein the first restriction is a check valve.

3. The power machine of claim 1, wherein the counterbalance valve is biased to a blocking position and wherein the pressurized fluid provided to the drive motor causes the counterbalance valve to shift from the blocking position to an open position to allow the flow to pass therethrough.

4. The power machine of claim 3, wherein the anti-cavitation valve is biased to a blocking position and wherein the pressurized fluid provided to the drive motor causes the anti-cavitation valve to shift from the blocking position to an open position to allow the flow to pass therethrough.

5. The power machine of claim 4, wherein a first biasing force is provided to bias the counterbalance valve to the blocking position and a second biasing force is provided to bias the anti-cavitation valve and wherein the first biasing force is lower than the second biasing force.

6. The power machine of claim 1 and further comprising a second restriction located between the control valve and the drive motor, wherein the first restriction is located between the control valve and the first port of the motor and the second restriction is located between the control valve and the second port of the motor.

7. The power machine of claim 6, wherein when the control valve is in the first position, the portion of the flow received by and passed through the anti-cavitation valve is directed to the first node positioned between the first restriction and the drive motor so that the flow bypasses the first restriction and is provided to the first port of the drive motor and when the control valve is in the second position, the portion of the flow received by and passed through the anti-cavitation valve is directed to a second node positioned between the second restriction and the drive motor so that the flow bypasses the second restriction and is provided to the second port of the drive motor.

8. A hydraulic circuit for a drive system on a power machine, comprising:

a hydraulic drive pump;

a drive motor capable of receiving pressurized fluid to operate in one of a first direction and second direction, the drive motor having a first port for receiving the pressurized fluid to operate in the first direction and a second port for receiving the pressurized fluid to operate in the second direction, wherein when the drive motor receives the pressurized fluid at the first port a return flow of the pressurized fluid is returned via the second port and wherein when the drive motor receives the pressurized fluid at the second port the return flow of the pressurized fluid is returned via the first port;

a control valve in communication with the hydraulic drive pump and configured to selectively direct the pressurized fluid to the first port of the drive motor in a first control valve position and to the second port of the drive motor in a second control valve position;

a first valve operable to receive the return flow from the drive motor;

a second valve operable to selectively receive the return flow from the control valve via the first valve and allow the return flow to pass therethrough; and a first restriction positioned between the hydraulic drive pump and the drive motor;

wherein a portion of the return flow received by and passed through the second valve is directed to a first node positioned between the first restriction and the drive motor so that the return flow bypasses the first restriction and is provided to the drive motor.

9. The hydraulic circuit of claim 8 and further comprising:

a second restriction positioned between the hydraulic drive pump and the drive motor, wherein when the control valve directs the pressurized fluid to the second port, the portion of the return flow received by and passed through the second valve is directed to a second node positioned between the second restriction and the drive motor so that the return flow bypasses the second restriction and is provided to the drive motor.

10. The hydraulic circuit of claim 9, wherein when the control valve moves from the first control valve position to the second control valve position, flow from the first node positioned between the first restriction and the drive motor is provided, through the second valve, to the second node positioned between second restriction and the drive motor and flow from the second valve is prevented from being returned to the control valve until the second valve has shifted.

* * * * *